US005294088A

United States Patent [19]

McWhorter et al.

[11] Patent Number: 5,294,088

[45] Date of Patent: Mar. 15, 1994

[54] VARIABLE BORE PACKER FOR A RAM-TYPE BLOWOUT PREVENTER

[75] Inventors: David J. McWhorter, Magnolia; Eric G. Childs, Katy, both of Tex.

[73] Assignee: Cooper Industries, Inc., Houston, Tex.

[21] Appl. No.: 959,254

[22] Filed: Oct. 13, 1992

[51] Int. Cl.[5] ..... E21B 33/06

[52] U.S. Cl. ..... 251/1.3; 277/129

[58] Field of Search ..... 251/1.1, 1.3; 277/129, 277/227

[56] References Cited

U.S. PATENT DOCUMENTS

| | | | |
|---|---|---|---|
| 4,323,256 | 4/1982 | Miyagishima et al. | 277/126 |
| 4,398,729 | 8/1983 | Bishop et al. | 277/73 |
| 4,428,592 | 1/1984 | Shaffer | 251/1.3 X |
| 4,456,215 | 6/1984 | Bishop et al. | 251/1.3 X |
| 4,506,858 | 3/1985 | Gentry | 251/1 A |
| 4,553,730 | 11/1985 | Vicic | 251/1.3 |
| 5,005,802 | 4/1991 | McWhorter et al. | 251/1.3 |
| 5,009,289 | 4/1991 | Nance | 251/1.3 X |

OTHER PUBLICATIONS

Cameron Oil Tools; *Choose Your Weapons. New B.O.P. Rams From Cameron Give You The Upper Hand When The Pressure's On.;* 1978; 8 pgs.

Cooper Oil Tool; *The Cameron FLEXPACKER® Ram;* 1992 Cooper Industries, Cooper Oil Tool Division, 1992; 4 pgs.

Cameron Today's solutions, tomorrow's standards. *Introducing CAMRAM® A Major Breakthrough in Ram Packer Technology;* Sep. 1987; 6 pgs.

*Primary Examiner*—John C. Fox

*Attorney, Agent, or Firm*—David A. Rose; Marcella D. Watkins

[57] ABSTRACT

The variable bore packer for a ram-type blowout preventer includes a body of resilient packing material with upper and lower plates embedded in the upper and lower surfaces of the body and upper and lower sets of insert segments disposed adjacent the upper and lower plates. The plates have arcuate radial corners at their terminal ends for preventing extrusion. Each of the insert segments includes a pair of insert plates forming an arcuate opening to receive an appropriate sized tubular member and dimensioned to expand and move rearwardly in the resilient packing material upon engagement with a larger diameter tubular member. A polyester rope is embedded in the resilient packing material adjacent the insert segments so as to bond with the resilient packing material. The rope prevents extrusion of the resilient packing material through the gaps between the insert segments and the exterior of the tubular member and also provides reinforcement of the resilient packing material upon the expansion of the resilient packing materials to accommodate larger diameter tubular members.

20 Claims, 4 Drawing Sheets

VARIABLE BORE PACKER FOR A RAM-TYPE BLOWOUT PREVENTER

BACKGROUND OF THE INVENTION

The present invention relates to blowout preventers and more particularly to variable bore packers for a ram-type blowout preventer which can be used for sealing different diameter tubular members extending through the blowout preventer and still more particularly to variable bore packers used in high pressure and high temperature wells.

Blowout preventers maintain control of downhole pressure in wells during drilling, and ram-type blowout preventers are used to close and seal around a string of pipe extending into the well to contain the pressure within the well. Variable bore packers have been designed for ram-type blowout preventers to close and seal around tubular members having different diameters within a limited range of sizes. Variable bore packers are designed to adjust their sealing engagement to the particular size of tubular member passing through the ram-type blowout preventer. Various types of prior art variable bore packers have been utilized.

U.S. Pat. No. 4,229,012 discloses a variable bore packer for a ram-type blowout preventer in which irising inserts, operated like a camera shutter, are embedded in the resilient packer and each include an upper plate, a lower plate and a rib connected between the upper and lower plates. Each of the plates is generally triangular in shape and designed to rotate as it moves inwardly with the resilient packer annulus so that the resilient material is supported when in sealing engagement with the exterior of a tubular member extending through the preventer. Also, a linkage structure is provided to allow the desired movement of the packer in sealing while maintaining its connection to the ram.

U.S. Pat. No. 5,005,802 discloses a variable bore packer having an upper and lower plate embedded in resilient packer material. A series of upper insert segments are positioned in the packer material below the upper plate and are removable with the packer material as it moves forward during sealing. The insert segments move inward with the packer material in sealing to provide an upper anti-extrusion support for the packer material upon sealing engagement around the exterior of a tubular member extending through the blowout preventer. The insert segments include an inner radius sized to match the outside diameter of the pipe against which it is to seal. The insert segments also include a radial length which is sufficiently long to allow them to move into engagement with a pipe exterior and still provide support for the resilient packer material to avoid its extrusion.

As variable bore packers sealingly engage tubular strings of different sizes, it is important to prevent the extrusion of the resilient packer material between the variable bore packer and the tubular member. Prior art packers continue to be subject to extrusion such that upon closing the variable bore packer around the tubular member, minute gaps continue to exist between the packer and tubular member. Such gaps become an increasing problem as the packer wears and is abraded by its sealing engagement with various tubular members passing through the blowout preventer. At times it is necessary to perform a "stripping" operation to strip the string through the closed rams. This stripping movement can severely wear or abrade the face of the resilient packer material.

The problem of extrusion is enhanced with increased downhole pressure and/or increased temperature. As downhole pressures increase to 15,000 psi, such large downhole pressures exacerbate the problem of extrusion due to the great pressure differential across the packer. Seventy or eighty cycles is a typical life span for ambient temperature packers. In high temperature packers, however, much more wear occurs in one cycle as in an ambient temperature packer. Further, as temperatures increase to high temperatures in the order of 350° F., the viscosity of the resilient packer material decreases causing it to be more fluid and thereby more susceptible to extrusion through the minute gaps between the packer and tubular member.

The variable bore packer of U.S. Pat. No. 4,229,012 does not lend itself to high temperature applications because it does not create a tight seal around the tubular member. The irising inserts cannot conform well to the diameter of the tubular member and leave a plurality of small gaps allowing extrusion by the less viscous packer material.

Various prior art packers have introduced filler material into the elastomer of the resilient packer material. U.S. Pat. No. 4,398,729 discloses a pipe ram with a removable packer insert made from HYTREL, a proprietary DuPont elastomer. U.S. Pat. No. 4,323,256 discloses a pipe ram with a packer insert made of a low friction material. The preferred material is stated as being Teflon with moly and fiberglass. U.S. Pat. No. 4,506,858 discloses a non-variable ram front packer with layers of reinforcing fabric molded into the elastomer to strengthen the elastomer. The fabric is a various combination of polyaramid, nylon and cotton duck. U.S. Pat. No. 4,553,730 discloses molding layers on non-metallic fabric into the top portion of a pipe ram packer to minimize the elastomer extrusion and also offer improved wear resistance during "stripping". Polyester fabric is listed as being a possible material for the non-metallic fabric.

A cross-section of wire has been used in bonnet seals. It is also known to use knitted wire mesh or braided wire in the packer material immediately adjacent the face of the wear plates to limit extrusion of the material. U.S. Pat. No. 4,428,592 also discloses a pipe ram with a packer having wire mesh molded into the packer face to resist wear during "stripping". U.S. Pat. No. 4,219,204 suggests the use of such knitted wire in a seal as an anti-extrusion means. It is also known to embed a canvass fabric in seals, such as mud pump piston seal rings, to provide extended seal life.

Polyester rope has been previously used in static elastomeric seals as an anti-extrusion material. Small diameter polyester rope is used to fill a space or crack through which the rope will not pass. For example, polyester rope has been used in wellhead seals.

It is also common industry practice to pre-shrink polyester or nylon rope prior to molding it into a rubber part. The pre-shrinking of the rope prevents it from later shrinking in the part when exposed to the high temperatures of the mold. Although polyester and nylon rope have previously been used for static seals, it is not known to use such rope for seals that change shape to conform to any of several sealing diameters.

SUMMARY OF THE INVENTION

The variable bore packer of the present invention for use in a ram-type blowout preventer includes a body of a resilient packing material with upper and lower plates embedded in the upper and lower surfaces of the body and upper and lower sets of insert segments disposed adjacent the upper and lower plates. The resilient packing material is a high temperature elastomer for high temperature service. The upper and lower plates include wing portions having extensions which form an arcuate radial corner which extends around the radial edge of the body to prevent extrusion behind the packer.

Each of the upper and lower sets of insert segments include a smaller insert segment for smaller diameter pipe and a larger insert segment for a larger diameter pipe. The larger insert segments are disposed between the plate and the smaller insert segment. Each of the insert segments includes a pair of insert plates forming an arcuate opening to receive the appropriate sized tubular member and dimensioned to expand and move rearwardly in the resilient packing material upon engagement with a larger diameter tubular member.

An anti-extrusion and reinforcement rope is also embedded in the resilient packing material adjacent the smaller insert segments. The rope is pre-shrunk and coated so as to bond with the resilient packing material. The rope is disposed adjacent the arcuate recess passing through the packer to prevent extrusion of the resilient packing material through any gaps between the insert segments and the exterior of the tubular member.

Other objects and advantages of the present invention will appear from the following description.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
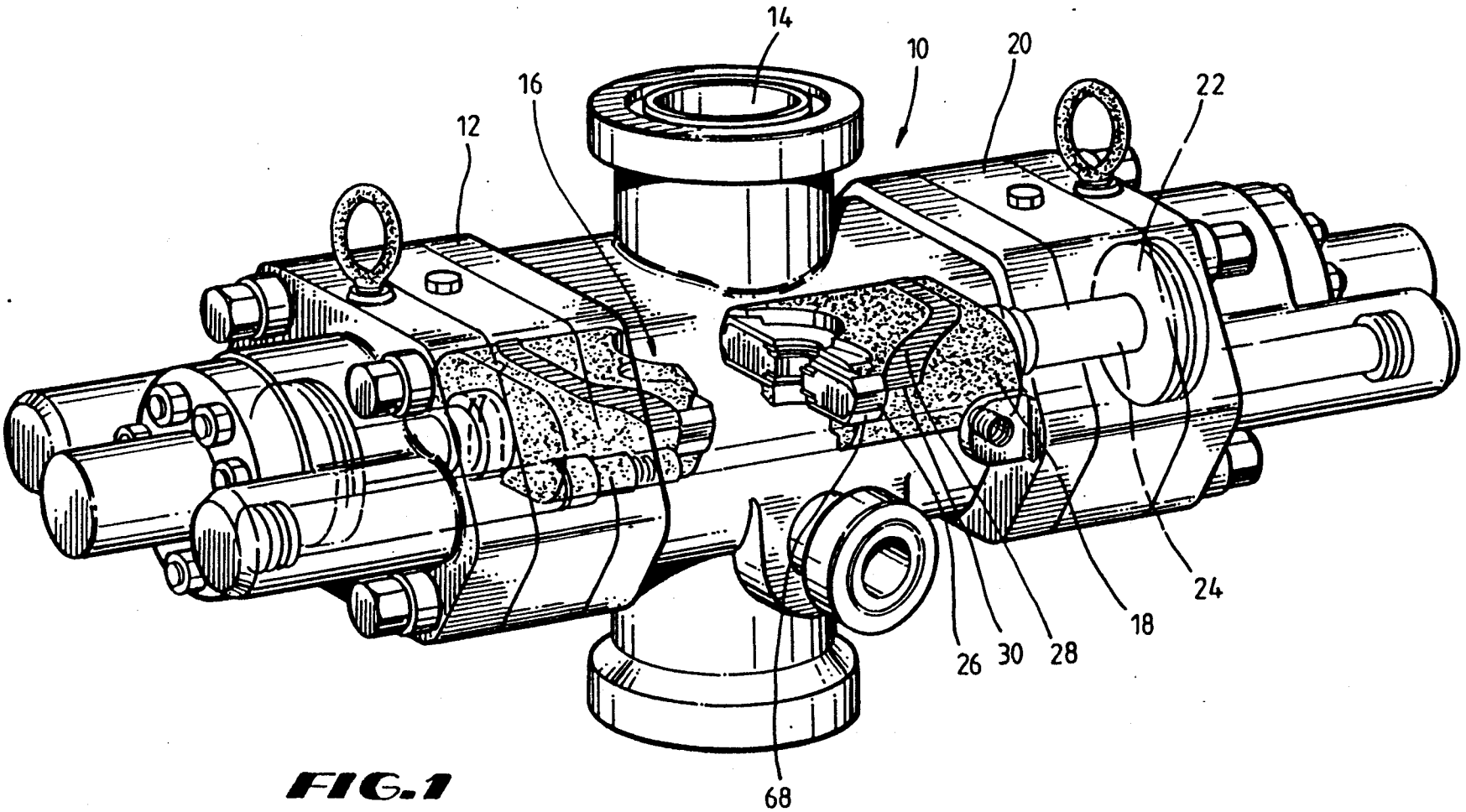
FIG. 1 is a perspective view, partially in section, of a ram-type blowout preventer on which the packer of the present invention is installed.
Figure 2:
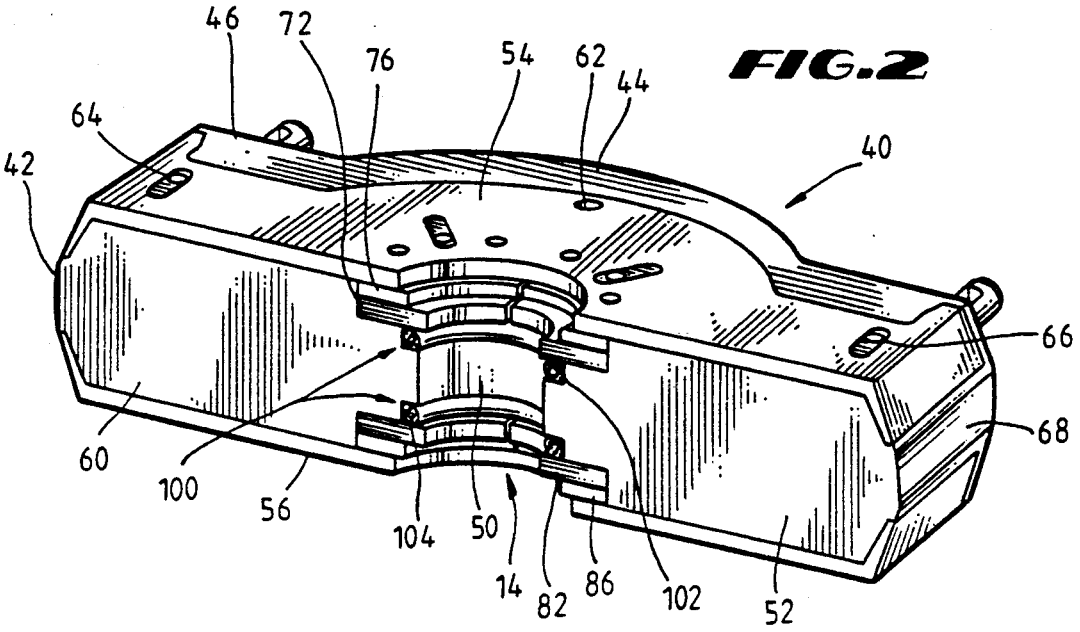
FIG. 2 is a perspective view of the variable bore packer of the present invention.

Referring initially to FIG. 1, there is shown a ram-type blowout preventer 10 which includes a housing or body 12 having a central vertical bore 14 therethrough with aligned opposed ram guideways 16 extending radially outward through body 12 from opposite sides of bore 14. Blowout preventer 10 is similar to the blowout preventer illustrated in U. S. Pat. No. 5,005,802, incorporated herein by reference. Each guideway 16 has a generally oval cross-section and includes a ram 18 reciprocally disposed therein. Each ram 18 is connected to an actuation means 20, such as a piston 22, by an actuator connecting rod 24 for moving rams 18 axially within their respective guideways 16 to open or close bore 14. While only one guideway 16 and ram 18 are shown, it is understood that there are two opposed guideways 16 and a ram 18 in each guideway 16. Each ram 18 includes a front face slot 26, only partially shown, for receiving a suitable packer therein with means coacting with the packer for securing it within slot 26. Packers normally are made of a resilient material and function to engage and seal against the exterior of a tubular member (not shown) which extends through central bore 14 and against which the ram packers are to close. Ram top seal 28 extends across the top of each ram 18 in groove 30 to provide a seal between ram 18 and the interior of guideway 16. Top ram seal 28 coacts with the packer to retain well pressure below rams 18 when rams 18 are in the closed position.

Referring now to FIGS. 2–6, the present invention includes an improved variable bore packer 40. Packer 40 includes a resilient body 42 having the usual packer shape, i.e. a D-shaped central portion 44 having optional radially extending wing portions 46, 48. Central portion 44 and wing portions 46, 48 have a common sealing face 52 extending from central face recess 50 forming a portion of central vertical bore 14. The outer terminal ends of wing portions 46, 48 from radial edges 68 which conform to the interior shape of the oval cross-sectioned guideways 16. Packer 40 further includes an upper plate 54 and a lower plate 56 with resilient packing material 60 therebetween. Upper and lower plates 54, 56 are separated by a shoulder pin 62 and two packer or T-pins 64, 66, hereinafter described in further detail. Embedded in the resilient packing material 60 of body 40 are an upper set 70 of insert segments and a lower set 80 of insert segments, both sets 70, 80 being positioned around central face recess 50.

each set 70, 80 of upper and lower insert segments includes an insert segment, made up of two identical insert plates, which is sized to receive a particular sized tubular member. Thus, the number of upper and lower insert segments in each set depends upon the number of different sizes of tubular members to be accommodated by ram-type blowout preventer 10. For purposes of illustration and not by way of limitation, the ram-type blowout preventer 10, as shown, will accommodate tubular members having a 3½ inch, 4½ inch and 5 inch diameter. Thus, upper and lower sets 70, 80 include a lower segment 72 and an upper insert segment 82 , respectively, to accommodate 3½ inch diameter tubular members and an upper insert segment 76 and a lower insert segment 86, respectively, to accommodate 4½ inch diameter tubular members. Upper insert segment 76 is disposed between upper plate 54 and lower insert segment 72 and lower insert segment 86 is disposed between lower plate 56 and upper insert segment 82. Upper and lower plates 54, 56 are sized to accommodate 5 inch diameter tubular members. Each of the insert segments 72, 82, 76, 86 and plates 54, 56 includes an arcuate recess or opening having a radius which will accommodate its particular size of tubular member.

High temperature elastomeric compounds are preferred over standard service elastomeric compounds for resilient packing material 60. A high temperature elastomeric compound will retain more of its original mechanical properties after it has been heated to a temperature in the order of 350° F. A standard service elastomeric compound becomes brittle and tends to crack as well as lose its sealing capability. The preferred resilient packing material 60 is a high temperature elastomer, such as a peroxide cured nitrile rubber compound.

Figure 4:
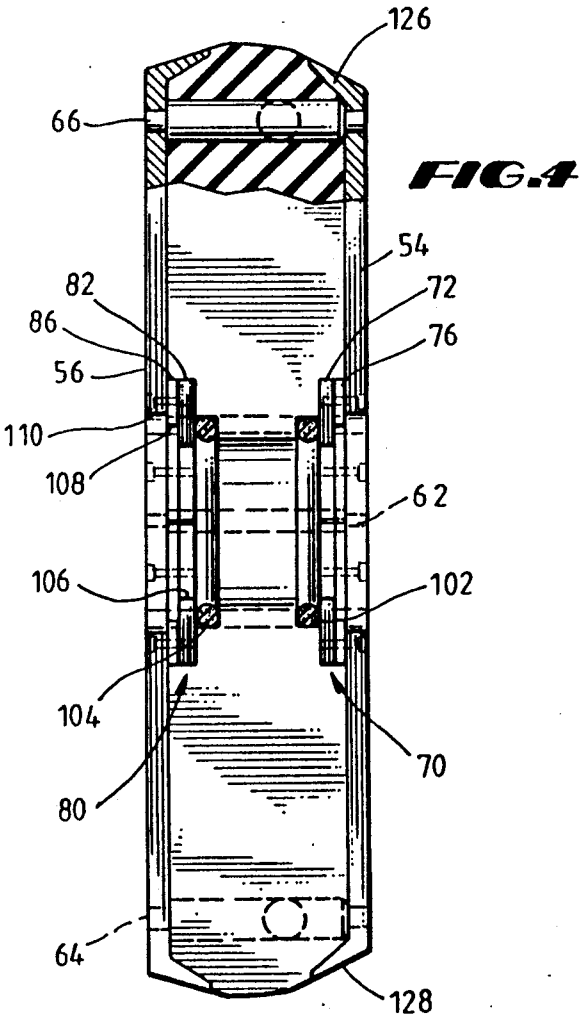
FIG. 4 is an elevational view of the variable bore packer of FIG. 2.
Figure 5:
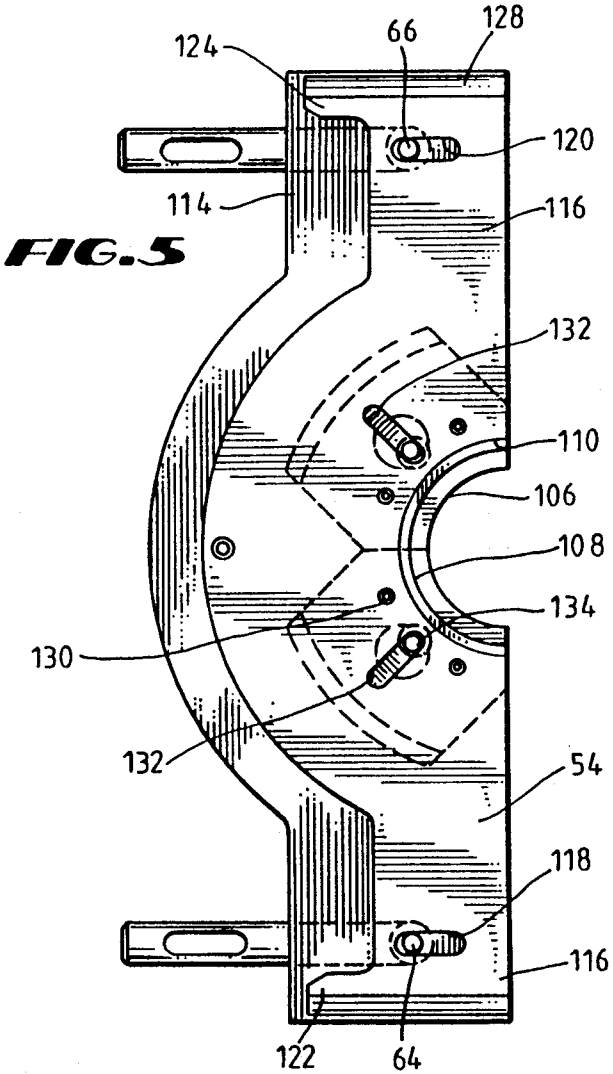
FIG. 5 is a top view of the variable bore packer of FIG. 4.

Variable bore packer 40 further includes anti-extension and reinforcement means 100 embedded in the resilient packing material 60 adjacent lower and upper insert segments 72, 82. Anti-extrusion and reinforcement means 100 extends around central packer bore recess 50 as hereinafter described. Anti-extrusion and reinforcement means 100 includes an upper and lower rope-like material 102, 104, respectively, embedded in the resilient packing material 60 around recess 50 and adjacent inserts 72, 82 as described above. As best shown in FIGS. 4 and 5, it can be seen that ropes 102, 104 have an inside diameter slightly greater than the diameter of arcuate opening 106 of lower insert segment 72 and upper insert segment 82. The ropes 102, 104 are preferably of polyester having the general composition of polyethylene tharalyte. It is preferred that ropes 102, 104 be double braided having a braided inner core with a braided outer overlay core so as to produce the desired diameter. A ½ inch nominal size polyester rope, such as that sold by Southwest Ocean Houston, Texas, is used in the present invention. The double braided rope 102, 104 is preferred over a single braid or a twisted rope because it holds its shape better while molding around the ropes 102, 104 with the resilient packing material 60. Ropes 102, 104 are pre-shrunk prior to molding ropes 102, 104 in resilient packing material 60, as hereinafter described.

The polyester rope is pre-shrunk so that it will not shrink further either during the molding process or once subject to high well temperatures. If the polyester rope were not pre-shrunk, it would tend to draw back into the packer 40 during the molding process and would not fully extend the full 180° around central recess 50. Another advantage of the polyester rope is that it does not require preforming prior to the molding process. The rope can be merely laid into the mold.

As indicated previously, it is not possible to obtain a perfect metal-to-metal seal between upper and lower plates 54, 56, insert segments 72, 76 and 82, 86, and the tubular member passing through vertical bore 14 of packer 40. There are always some gaps which can allow the passage of the resilient packing material 60, particularly at high temperatures when the resilient packing material 60 loses viscosity and becomes highly fluid and susceptible to extrusion even though small gaps. By disposing ropes 102, 104 adjacent smaller insert segments 72, 82, as the resilient packing material 60 attempts to extrude through the gaps, the material 60 engage ropes 102, 104 which prevents material 60 from extruding.

Ropes 102, 104 not only prevent extrusion of the resilient packing material 60 between upper and lower plates 54, 56, insert segments 72, 76 and 82, 86, and the tubular member, but also provide reinforcement to the resilient packing material 60 as packer 40 receives larger diameter tubular members which cause the rubber bore recess 50 to expand to accommodate the larger size tubular member. Ropes 102, 104 reinforce resilient packing material 60 and serve a binding effect to the material 60 to prevent material 60 from cracking as large diameter tubular members are sealed in packer 40. For example, when a five inch diameter tubular member is placed within packer 40, the original 3½ inch arcuate opening of recess 50 of packer 40 is stressed and expanded in size to accommodate the larger five inch diameter tubular member. The stretching of the resilient packing material 60 to the larger size tends to cause the resilient material 60 to split as it is stretched to the larger diameter opening. The ropes 102, 104 reinforce the resilient material so as to prevent the resilient elastomeric material 60 from splitting and cracking.

Figure 3:
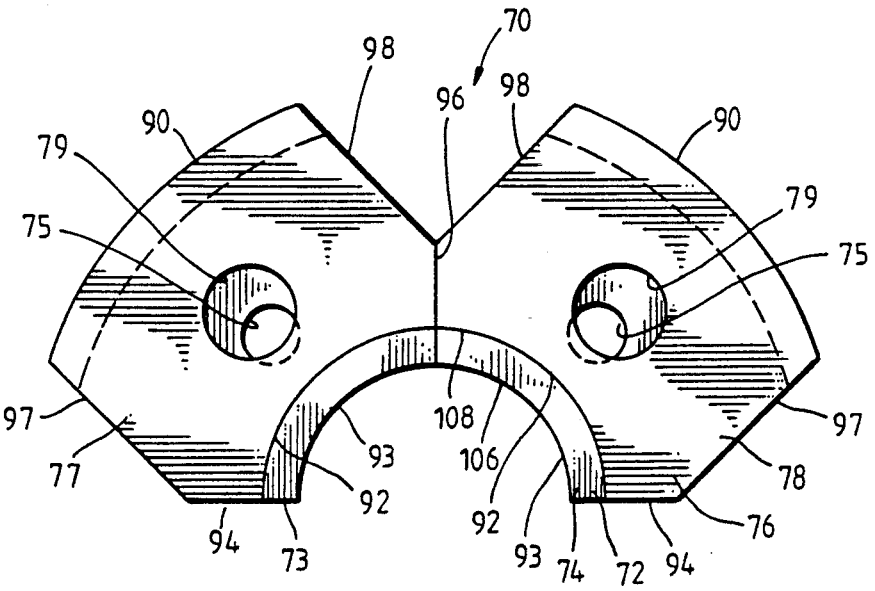
FIG. 3 is a plan view of the upper set of insert segments of the variable bore packer of FIG. 2.

Referring now to FIG. 3, there is shown the upper set 70 of insert segments which include lower insert segment 72 for 3½ inch diameter tubular members and upper insert segment 76 for 4½ inch diameter tubular members. Since the lower set 80 of insert segments is identical to the upper set 70 of insert segments, it should be appreciated that the description of insert segments 72, 76 of upper set 70 will be applicable to insert segments 82, 86 of lower set 80. Note also that the general shape of upper insert segment 76 is comparable to that of lower insert segment 72.

As shown in FIG. 3, lower insert segment 72 includes two identical insert plates 73, 74 and upper insert segment 76 includes two identical insert plates 77, 78. Insert plates 73, 74 and 77, 78 are generally 90° arcuate plates having a rear arcuate end 90, a forward arcuate end 92, 93, respectively, a facing side 94, and an inner side 96. Facing side 94 and inner side 96 are chamfered 45° at 97, 98. The forward arcuate ends 92, 93 of insert plates 73, 74 and 77, 78 form D-shaped arcuate recesses or openings 106, 108 having a diameter substantially equal to the 3½ inch and 4½ inch diameter tubular members to be engaged. As shown, inner sides 96 of insert plates 73, 74 and 77, 78 are opposed so as to be in engagement when upper and lower sets of insert segments 70, 80 are in the open position.

As shown in FIG. 3, although the shapes of insert plates 73, 74 are similar to that of insert plates 77, 78, it can be seen that certain dimensions vary. For example, the facing sides 94 of insert plates 73, 74 are longer than that of insert plates 77, 78. Further, chamfered sides 97, 98 of insert plates 77, 78 are longer than that of insert plates 73, 74. Note too, that the inner sides 96 of insert plates 73, 74 are longer than that of insert plates 77, 78. These differences in dimensions are due to the operation of the insert plates upon closing the packers around different sized tubular members.

Each insert segment 72, 76 includes a different arcuate recess or opening 106, 108, respectively, to fit around a particular diameter tubular member. The arcuate opening 106 of the lower insert segment 72 will tightly engage the smallest diameter tubular member, i.e. 3½ inches, to prevent the resilient packing material 60 from extruding through any gaps formed between the forward arcuate ends 93 and the exterior surface of the tubular member. Since the lower insert segment 72 has the smaller arcuate opening 106, it projects further into central bore 14 and is thereby cantilevered further than is upper insert segment 76. Thus, as best shown in FIG. 4, insert segments 72, 82 have a greater thickness than insert segments 76, 86 so as to withstand the larger bending moment on insert segments 72, 82 caused by their greater exposure to downhole pressure due to their greater projection into vertical bore 14.

In sizing insert segments 72, 76 and 82, 86 not only is the radius of arcuate openings 106, 108 sized to match the outside diameter of the tubular member against which it is to seal, but the radial length of the insert segments is sufficiently long to allow the insert segments to move into engagement with the exterior of the tubular member and still provide the necessary support for the resilient packing material 60 to avoid extrusion between the insert segments and tubular member. The circumferential space between the individual insert plates is selected to be sufficient to allow the desired radial inward movement of the insert plates into their supporting position.

The lower set 80 of insert segments 82, 86 is the same as the upper set 70 of insert segments 72, 76 except that insert segments 82, 86 are reversed in position in that insert segment 82 is the upper insert segment of set 80 and insert segment 86 is the lower insert segment of set 80. Upper insert segment 82 includes an arcuate opening 106 sized for 3½ inch diameter tubular members and lower insert segment 86 includes an arcuate opening 108 sized for 4½ inch diameter tubular members.

Upon closing the packer 40 around a 4½ inch tubular member, the tubular member engages facing side 93 of smaller insert segments 72, 82 tending to push insert plates 73, 74 back into the resilient packing material 60 until the tubular member engages the facing side 92 of arcuate opening 108 of larger insert segments 76, 86. The inner sides 96 of insert plates 73, 74 disengage and spread apart to provide a sufficient arcuate opening at 106 to allow the larger 4½ tubular member to engage larger insert segments 76, 86. Insert plates 77, 78 of insert segments 76, 86 perform in a similar fashion upon sealing a 5 inch tubular member in packer 40.

The lower insert segment 72 has shorter chamfered sides 97, 98 to allow it to move further rearward upon utilizing larger diameter pipe in the packer 40. The 45° chamfered sides 98 allows insert segments 72, 76 to open and move rearward into resilient packing material 60 without engaging rear shoulder pin 62. Also, it has been found that by having 45° chamfered sides 97, 98, the packing material molded around the edges of chamfered sides 97, 98 causes upper and lower sets 70, 80 of insert segments to better maintain their position within resilient packing material 60.

Figure 6:
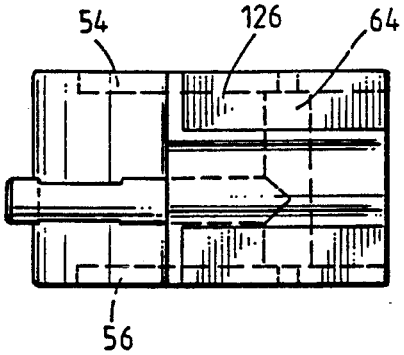
FIG. 6 is a side elevational view of the variable bore packer of FIGS. 4 and 5.
Figure 7:
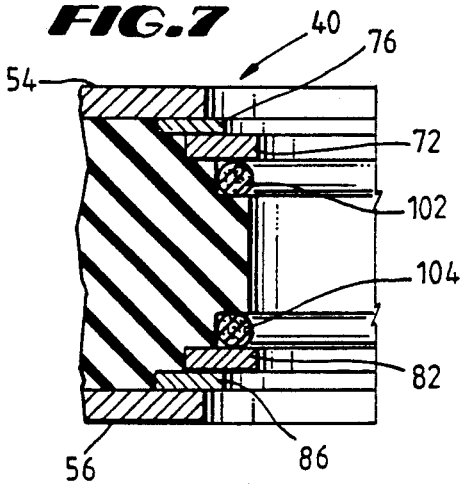
FIG. 7 is a partial sectional view of the packer shown in FIG. 4 and illustrating the packer in its retracted and open position.

Referring now to FIGS. 4–6, upper and lower plates 54, 56 have a central arcuate portion 112 and elongated wing portions 114, 116. Wing portions 114, 116 are generally rectangular in shape and extend to the radial edge 68 of the packer 40. Central portion 112 includes a forward arcuate recess and opening 110 sized to accommodate a 5 inch diameter tubular member. Upper and lower plates 54, 56 are separated a predetermined distance by shoulder pin 62 and T-pins 64, 66. As best shown in FIG. 4, upper and lower plates 54, 56 include apertures for receiving reduced diameter end portions of shoulder pin 62. The reduced diameter end portions form shoulders which engage the inner surfaces of upper and lower plates 54, 56 to prevent the plates from moving together. Likewise, wing portions 114, 116 include elongated slots 118, 120 for receiving the reduced diameter ends of T-pins 64, 66, respectively. Shoulder pin 62 and T-pins 64, 66 space upper and lower plates 54, 56 apart. Shoulder pin 62 is particularly used to prevent the rear portion of plates 54, 56 from tipping backwards when the resilient packing material is injected from the rear of the plates 54, 56. T-pins 64, 66 include horizontally and rearwardly projecting shafts to secure packer 40 within the front recess 26 of rams 18.

At the extreme radial terminal ends of wing portions 114, 116, there are included rearwardly extending wing extensions 122, 124. Wing portions 114, 116 and wing extensions 122, 124 form lateral arcuate radial corners 126, 128, respectively, which extend around the curvature of the radial edge 68 of the packer 40. The arcuate corners 126, 128 extend rearwardly to almost the back of the packer 40.

While insert segments 72, 76 and 82, 86 and upper and lower plates 54, 56 prevent extrusion between the packer 40 and the tubular member extending through central vertical bore 14, arcuate corners 126, 128 prevent extrusion from around the back of the packer 40 near upper and lower plates 54, 56. As shown in FIG. 1, packers 40 are disposed within front insert 26 of ram 18 with packer radial edges 68 sealingly engaging the inner wall of guideway 16. As previously indicated, a packer top seal 28 is also provided which extends across the top of the metal ram 18 and the interior wall of guideway 16. Packer top seal 28 seals against downhole pressures from passing around the back of ram 18. Thus, one of the critical interfaces is the interface between packer top seal 28 and packer 40. The resilient packing material 60 of packer 40 tends to extrude up and around the radial ends 68 of packer 40. Because packer 40 is a variable bore packer, the changing of tubular members with different diameters causes the closing distance of the packer 40 to constantly change and, therefore, causes the interface between the top seal 28 and packer 40 to change. In other words, upper and lower plates 54, 56 tend to move in and out radially with respect to central vertical bore 14 depending upon the diameter size of the tubular member passing through bore 14. Such movement causes the area behind the packer 40 to be vulnerable to losing resilient packing material 60.

The arcuate corners 126, 128 on upper and lower plates 54, 56 prevent extrusion along the radial edges 68 of packer 40 and prevent extrusion between wing portions 114, 116 and the wall of guideway 16 such that upon applying a high rubber pressure, the radial corners 126, 128 tend to move radially outward and contact the internal wall of guidewaay 16 to prevent resilient packing material 60 from extruding around arcuate radial corners 126, 128 of upper and lower plates 54, 56. Radial corners 126, 128 are flexible and tend to flex outward so as to establish a sealing engagement with guideway 16 and prevent extrusion of resilient packing material 60. Although the flexible arcuate corners 126, 128 flex outward against the wall of guideway 16, the resilient packing material 60 forms the seal to prevent extrusion.

Several steps are required to produce packer 40. As previously indicated, polyester ropes 102, 104 are processed prior to being placed in the mold. A length of the polyester rope is placed into an oven and baked at a temperature of 400° to 425° F. for approximately one hour. The rope is removed and allowed to cool to room temperature. The pre-shrunk rope is then cut to a desired length for placing in the packer mold. The pre-cut rope is dipped into an adhesive, such as the rubber-to-polyester adhesive manufactured by the Lord Corporation of Erie, Pa., to facilitate the bonding of the rope to the resilient packing material 60 of packer 40. This adhesive includes two parts by volume of Chemlok 252 and one part by volume of 1,2,1 Trichloroethane. The rope is then removed from the adhesive and allowed to dry for a period of 24 hours. The coating of adhesive assures a good bonding with the hot elastomeric material which will form the resilient packer material 60. The hot elastomeric material and coating on the polyester rope fuse together with the coating fusing to the rope and the hot elastomeric material fusing to the coating. After the adhesive is dried, the pre-shrunk polyester rope is ready for placement into a packer mold along with the upper and lower sets 70, 80 of insert segments and upper and lower plates 54, 56.

The packer mold includes a central core. In the installation of the rope in the mold, a 12 gauge wire is wrapped around each end of the rope leaving approximately 4 inches of wire length available for attachment of the two ends. The rope is held in position and one end of the wire is attached to one end of the rope. The wire is then extended around the back side of the core and attached to the other end of the rope. This positively locates the rope within the mold. The core is then loaded into the mold and the rubber is injected into the mold. The part is then removed with the core. The end of the wires are detached and the core is removed. After the packer is taken out of the mold, the ends of the rope are clipped flush against the packer face with a small portion of the wire loop buried within the resilient packing material 60 of the packer.

Referring now to FIGS. 3–5, assembly pins or screws 130 pass through apertures in upper and lower plates 54, 56 and are threaded into apertures in the upper and lower sets 70, 80 of insert segments 72, 76 and 82, 86. Assembly screws 130 hold the plates and insert segments together during the injection molding process. Once the elastomeric material has been injected into the mold, there is no longer any necessity for screws 130. Therefore, once the hot packer is removed from the mold, screws 130 are removed from the plates and insert segments so that they are no longer connected together and are free to move with respect to each other such as when a tubular member is placed within packer 40.

As shown in FIGS. 3–5, insert plates 73, 74 of insert segment 72 each have a small diameter hole 75 therethrough and insert plates 77, 78 of insert segment 76 each have a larger diameter hole 79 therethrough. Also, best shown in FIG. 5, upper plate 54 includes two elongated slots 132 whereby slot 132 is aligned with apertures 75, 79 to receive a retaining pin 134. Such apertures and slot are also included in lower set 80 and lower plate 56.

Retaining pin 134 is dropped through apertures 75, 79 and slot 132 and the elastomeric material is injection molded around it. Retaining pin 134 sits in apertures 75, 79 and slot 132 until after the injection molding with the elastomeric material retaining pin 134 in place. The elastomeric material fills apertures 75, 79 and slot 132 such that retaining pin 134 is buried within resilient packing material 60. Retaining pin 134 limits and guides the rearward motion of insert segments 72, 76 and 82, 86 by engaging the rim of slots 132 in upper and lower plates 54, 56. Slots 132 are angled at 45° so as to cause the inserts to also move at that 45° angle.

Under certain circumstances, the packing material 60 will erode around insert segments 72, 76 and 82, 86 so as to expose the insert segments. If this erosion is combined with a poor rubber bond between resilient packing material 60 and insert segments 72, 76, and 82, 86, the insert plates could fall into the well through vertical bore 14. If the insert plates have oil on them or if the temperature of the mold is not maintained properly, or if for some other reason a rubber-to-metal bond is not achieved, the insert segments come loose from packer 40. Also, sometimes the packer 40 is misused and is closed on something other than tubular pipe under pressure causing the packing material 60 to erode. The packer 40 could then lose a large volume of packing material 60 exposing the insert segments. Not only will the packer 40 not seal properly, but the insert segments can drop downhole requiring an expensive fishing operation as well as ruin the drill bits. The retaining pins 134 prevent the individual insert plates 73, 74 and 77, 78 of insert segments 72, 76 and 82, 86 from dropping downhole. Apertures 75, 79 and slot 132 are sized such that the individual insert plates 73, 74 and 77, 78 have sufficient freedom of movement to allow the insert plates to move in whatever direction is required during the operation of the packer 40.

Prior to molding, T-pins 64, 66 are in place and top and bottom plates 54, 56 have shoulder pins 62 inserted. The insert segments 72, 76 and 82, 86 are fastened by screws 130 to upper and lower plates 54, 56 and retaining pin 134 is dropped into apertures 75, 79 and slot 132. The elastomeric material is then injection molded into the mold from the rear of the packer 40 with the packer 40 in its smallest diameter position.

Referring now to FIGS. 7–10, packer 40 is shown in operation sealing with various sized diameter tubular members 140. The present invention is designed to operate at well pressures up to 15,000 psi and at temperatures up to 350° F. The sealing position of the present invention is shown for small diameter tubular members in FIG. 8, intermediate diameter tubular members in FIG. 9 and large diameter tubular members in FIG. 10.

Figure 8:
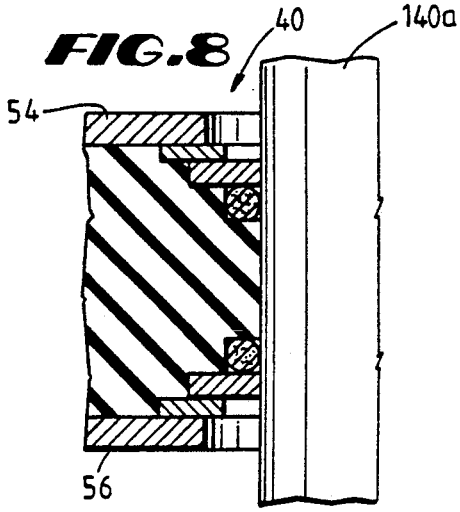
FIG. 8 is another partial sectional view of the packer similar to that of FIG. 7 and illustrating the packer in its sealed position against the smallest size of tubular member extending through the bore of the blowout preventer against which the packer is to seal.

Referring now to FIG. 8, rams 18 are actuated to move the opposing halves of packer 40 into sealing position around tubular member **140*a* extending through central vertical bore 14 of blowout preventer 10. Tubular member 140*a* extends through the central face recess 50 forming a portion of central vertical bore 14. Tubular member 140*a* has a nominal diameter of 3½ inches. The forward arcuate ends 93 of insert plates 73, 74 making up insert segments 72, 82 engage the external surface of tubular member 140A as tubular member 140A is received within arcuate recess or opening 106 of insert segments 72, 82. The rams 18 place sufficient force on the two halves of packer 40 to create a rubber pressure of approximately 1½ times that of the downhole pressure of the well. Ropes 102, 104 also engage the external surface of tubular member 140*a* just below lower insert segment 72 and just above upper insert segment 82. Small diameter insert segments 72, 82 form a metal-to-metal engagement around tubular member 140*a*. Also, it can be appreciated that the common sealing face 52 of wing portions 46, 48 on both halves of packer 40** come into sealing engagement.

In high pressure wells having downhole pressures up to 15,000 psi, a rubber pressure must be created by ram 18 to packer 40 around tubular member **140*a* at a level greater than 15,000 psi. Preferably, the rubber pressure will be approximately one and one-half times that of the 15,000 psi wellbore pressure such that a rubber pressure of approximately 22,000 psi will be generated. If the rubber pressure is less than the downhole pressure, the wellbore fluids will leak through the packer 40. Since there is a pressure differential across the packer 40 of the difference between the 15,000 psi downhole pressure and the ambient pressure at the surface, that pressure differential will cause the resilient packing material 60 to extrude through the gaps between the packer 40 and tubular member 140***a*.

Because the high rubber pressures of 22,000 psi required to seal against a 15,000 wellbore pressure, there is also created a downward pressure differential. Although the tendency for extrusion downward is not as great, and a bigger gap between packer 40 and tubular member 140*a* is required for extrusion to occur, the lower set 80 of insert segments 82, 86 are required to prevent any downward extrusion. This is particularly a problem at high temperatures when the viscosity of the resilient packing material 60 becomes very low. At ambient temperatures, downward extrusion is not considered a problem.

Figure 9:
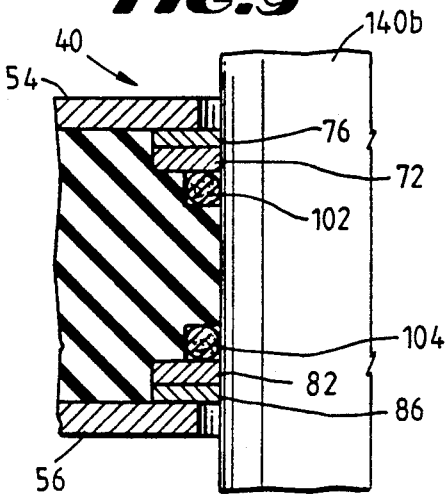
FIG. 9 is another partial sectional view of the packer similar to FIGS. 7 and 8 but illustrating the packer sealed against an intermediate size tubular member.

Referring now to FIG. 9, packer 40 is shown in sealing position around an intermediate diameter tubular member 140*b*. As can be seen, the insert plates 73, 74 of insert segments 72, 82 have moved apart to increase arcuate opening 106 and allow arcuate opening 108 of insert segments 76, 86 to receive the intermediate diameter tubular member 140*b*. As previously indicated, insert segments 72, 82 are pushed back into the resilient packing material 60 guided by retaining pin 134 in slots 132 in upper and lower plates 54, 56. Ropes 102, 104 reinforce the resilient packing material between insert segments 72, 82 to prevent splitting and cracking. Also, ropes 102, 104 prevent extrusion.

Figure 10:
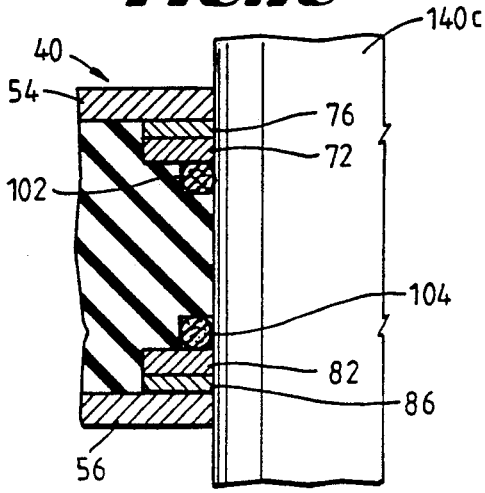
FIG. 10 is another partial sectional view similar to FIGS. 7, 8 and 9 but illustrating the packer sealed against a larger size tubular member against which it is to seal.

Referring now to FIG. 10, the packer 40 is shown in sealing position with a large diameter tubular member 140*c*, such as a 5 inch diameter pipe. Both upper and lower sets 70, 80 of insert segments 72, 76 and 82, 86 are pushed rearwardly into resilient packing material 60 and are guided by retaining pin 134 moving within slots 132 of upper and lower plates 54, 56. Insert plates 77, 78 of insert segments 76, 86 as well as insert plates 73, 74 of insert segments 72, 82 expand to accommodate the larger size pipe moving within annular recess 110 of plates 54, 56. Again ropes 102, 104 bonded to resilient packing material 60 prevents material 60 from splitting and cracking as arcuate openings 106, 108 further expand to accommodate the larger size tubular member.

As an alternative to bonding ropes 102, 104 in resilient packing material 60, resilient packing material 60 of packer 40 may include a filler material, such as fiberglass or wire, such that the filler material is approximately thirty percent of the resilient packing material 60 used for packer 40. For example, fiberglass may be chopped into small strands and then mixed with the elastomeric material such that the small strands of fiberglass permeate resilient packing material 60. Elastomeric material including a fiberglass filler, as for example the product ¢Superwear" manufactured by the Gates Molded Products Company, has a very high sealing capacity. The elastomeric material is very strong and highly resistent to extrusion since the properties of the elastomeric material change when filled with a filler.

The resilient packing material 60 may also be preformed by using a wire mesh with rubber injected under pressure to penetrate the mesh. In using a fiberglass or wire filled elastomeric material for packing material 60, the polyester rope 102, 104 would not be required since the solid filler material mixed with the elastomeric material will have sufficient capability to prevent extrusion.

While a preferred embodiment of the invention has been shown and described, modifications thereof can be made by one skilled in the art without departing from the spirit of the invention.

We claim:

1. A variable bore packer in a ram-type blowout preventer for sealing different diameter tubular members, comprising:

first and second plates having a central arcuate opening and facing inner sides;

first and second smaller insert segments having a smaller central arcuate opening co-axial with said central arcuate opening for receiving the tubular members;

said first smaller insert segment being disposed adjacent said inner side of said first plate and said second smaller insert segment being disposed adjacent said inner side of said second plate;

first and second larger insert segments having a larger central arcuate opening co-axial with said central arcuate opening for receiving tubular members;

said first larger insert segment being disposed between said first plate and first smaller insert segment and said second larger insert segment being disposed between said second plate and second smaller insert segment;

a resilient packing material molded between said first and second plates and embedding said first and second plates and said first and second insert segments in said resilient packing material; and said first and second smaller and larger insert segments seating respectively against a correspondingly sized tubular member to prevent extrusion of the resilient packing material between said first and second plates and the tubular member.

2. The ram of claim 1, further including a braided fiber non-impregnated with said resilient packing means and molded in said resilient packing material and extending around said smaller central arcuate opening adjacent said first and second smaller insert segments for reinforcing said resilient packing material and for preventing extrusion of said resilient packing material between said first smaller insert segment and the tubular member.

3. The ram of claim 1, further including retaining means for preventing said insert segments from falling out of said packer, said retaining means comprising a retaining pin slidably connecting each said plate and said adjacent insert segments.

4. The ram of claim 3 wherein said plates include angled guide slots therethrough and said insert segments include holes therethrough, said holes being aligned with said slots, said retaining pin being received in said slots and said holes so that motion of said insert segments is guided by said pin moving within said slots.

5. The variable bore packer of claim 1 wherein each of said insert segments comprises a pair of insert plates, said insert plates being generally 90° arcuate plates having 45° chamfered facing and inner sides.

6. A variable bore packer in a ram-type blowout preventer for sealing different diameter tubular members, comprising:

first and second plates having a central arcuate opening and facing inner sides;

first and second smaller insert segments having a smaller central arcuate opening co-axial with said central arcuate opening for receiving the tubular members;

said first smaller insert segment being disposed adjacent said inner side of said first plate and said second smaller insert segment being disposed adjacent said inner side of said second plate;

a resilient packing material molded between said first and second plates and embedding said first and second plates and said first and second insert segments in said resilient packing material;

said first and second insert segments seating against the tubular member to prevent extrusion of the resilient packing material between said first and second plates and the tubular member; and polyester rope for reinforcing said resilient packing material upon sealing a tubular member having a diameter greater than said smaller central arcuate opening.

7. The variable bore packer of claim 6 further including first and second larger insert segments having a larger central arcuate opening co-axial with said central arcuate opening for receiving tubular members, said first larger insert segment being disposed between said first plate and first smaller insert segment and said second larger insert segment being disposed between said second plate and second smaller insert segment.

8. The variable bore packer of claim 7 wherein said first and second smaller insert segments have a thickness greater than said first and second larger insert segments.

9. The variable bore packer of claim 7 further including guide means for guiding the movement of said first and second smaller and larger insert segments.

10. The variable bore packer of claim 7 wherein each of said first and second smaller and larger insert segments includes a pair of insert plates.

11. The variable bore packer of claim 10 wherein said insert plates are generally 90° arcuate plates having 45° chamfered facing and inner sides.

12. A variable bore packer in a ram-type blowout preventer for sealing different diameter tubular members, comprising:

first and second plates having a central arcuate opening and facing inner sides;

first and second smaller rigid insert segments having a smaller central arcuate opening co-axial with said central arcuate opening for receiving the tubular members;

said first smaller insert segment being disposed adjacent said inner side of said first plate and said second smaller insert segment being disposed adjacent said inner side of said second plate;

a resilient packing material molded between said first and second plates and embedding said first and second plates and said first and second insert segments in said resilient packing material;

said first and second insert segments seating against the tubular member to prevent extrusion of the resilient packing material between said first and second plates and the tubular member; and first means non-impregnated with said resilient packing material and molded in said resilient packing material adjacent said first smaller insert segment for preventing extrusion of said resilient packing material between said first smaller insert segment and the tubular member;

said first means extending around said smaller central arcuate opening and preventing extrusion of said resilient packing material therethrough.

13. The variable bore packer of claim 12, further including second means molded in said resilient packing material adjacent said second smaller insert segment for preventing extrusion of said resilient packing material between said second smaller insert segment and the tubular member, said second means extending around said smaller central arcuate opening and preventing extrusion of said resilient packing material therethrough.

14. The variable bore packer of claim 12 wherein said first means is a rope-like material.

15. A variable bore packer in a ram-type blowout preventer for sealing different diameter tubular members, comprising:

first and second plates having a central arcuate opening and facing inner sides;

first and second smaller insert segments having a smaller central arcuate opening co-axial with said central arcuate opening for receiving the tubular members;

said first smaller insert segment being disposed adjacent said inner side of said first plate and said second smaller insert segment being disposed adjacent said inner side of said second plate;

a resilient packing material molded between said first and second plates and embedding said first and second plates and said first and second insert segments in said resilient packing material;

said first and second insert segments seating against the tubular member to prevent extrusion of the resilient packing material between said first and second plates and the tubular member;

first means embedded in said resilient packing material adjacent said first smaller insert segment for preventing extrusion of said resilient packing material between said first smaller insert segment and the tubular member; and said first means being a pre-shrunk polyester rope.

16. The variable bore packer of claim 15 wherein said pre-shrunk polyester rope includes an adhesive coating for bonding to said resilient packing material.

17. A variable bore packer in a ram-type blowout preventer for sealing different diameter tubular members, comprising:

upper and lower generally rectangular plates each having a major front edge with a central arcuate recess and two side edges generally perpendicular to said major front edge and extending rearwardly therefrom;

said upper and lower plates having facing inner sides;

a first smaller insert segment having a smaller central arcuate opening co-axial with said central arcuate opening for receiving the tubular members;

said first smaller segment being disposed adjacent said inner side of said upper plate;

a resilient packing material molded between said upper and lower plates and embedding said upper and lower plates and said first insert segment in said resilient packing material;

said first smaller insert segment seating against the tubular member to prevent extrusion of the resilient packing material between said upper plate and the tubular member; and said upper and lower plates extending to a radial, terminal edge of the packer and said side edges including radial arcuate inwardly projecting extensions extending across a portion of said resilient packing material for preventing extrusion of said resilient packing material around the radial, terminal edge of the packer.

18. A variable bore packer in a ram-type blowout preventer for sealing different diameter tubular members, comprising:

upper and lower plates having a central arcuate opening and facing inner sides;

a first smaller insert segment having a smaller central arcuate opening co-axial with said central arcuate opening for receiving the tubular members;

said first smaller insert segment being disposed adjacent said inner side of said upper plate;

a resilient packing material molded between said upper and lower plates and embedding said upper and lower plates and said first insert segment in said resilient packing material;

said first smaller insert segment seating against the tubular member to prevent extrusion of the resilient packing material between said upper plate and the tubular member; and said upper and lower plates extending to a radial, terminal edge of the packer and including radial arcuate corners at the radial terminal edge for preventing extrusion of said resilient packing material around the radial, terminal edge of the packer, said radial arcuate corners being flexible and contacting an internal surface of the blowout preventer when sealing pressure is exerted by the ram.

19. A variable bore packer in a ram-type blowout preventer for sealing different diameter tubular members, comprising:

a housing having a bore with aligned oval cross-sectioned ram guideways extending through the housing from opposite sides of said bore;

a ram in each of said ram guideways having a front face facing said bore;

means for moving the rams inwardly and outwardly in said guideways;

a packer affixed to each of said rams, each packer comprising:

a central D-shaped body having a central face recess and radially extending wings, said central face forming a central vertical bore, and said D-shaped body comprising at least one D-shaped face plate adjacent at least one D-shaped mass of resilient material;

said central face recess and said wings having a common sealing face;

each of said face plates including radially extending wings having outer terminal side edges, said outer terminal side edges forming substantially perpendicular, inwardly curved, radial extensions which conform to the interior shape of the oval cross-sectioned ram guideways.

20. A ram according to claim 19 wherein said terminal extensions flex toward the outer edge of the ram when pressure is applied to the ram, to prevent extrusion around the packer.

* * * * *